United States Patent [19]

Zanavich et al.

[11] Patent Number: 4,540,160

[45] Date of Patent: Sep. 10, 1985

[54] RAIL FENCE

[76] Inventors: James K. Zanavich, Lake Shore Dr.; Alfred M. Smith, 487 Whittemore Rd., both of Middlebury, Conn.

[21] Appl. No.: 594,387

[22] Filed: Mar. 28, 1984

[51] Int. Cl.[3] ..... E04H 17/14

[52] U.S. Cl. ..... 256/19; 256/13.1; 256/66

[58] Field of Search ..... 256/19, 65, 66, 13.1

[56] References Cited

U.S. PATENT DOCUMENTS

| | | | |
|---|---|---|---|
| 3,107,900 | 10/1963 | DePaolo | 256/65 |
| 3,700,213 | 10/1972 | Blease | 256/19 |
| 3,720,401 | 3/1973 | Loch et al. | 256/19 |
| 4,124,198 | 10/1977 | Wong | 256/19 X |
| 4,324,388 | 4/1982 | Klaser | 256/19 |

FOREIGN PATENT DOCUMENTS

| | | | |
|---|---|---|---|
| 2068499 | 8/1981 | United Kingdom | 256/65 |

*Primary Examiner*—Andrew V. Kundrat
*Attorney, Agent, or Firm*—Lawrence Hager

[57] ABSTRACT

A fence construction which utilizes a plurality of constituent rail and post members configured to facilitate assembly and erection of a fence. The rail and post members are formed from a plastic material to provide a virtually maintenance free fence structure which is relatively imperishable.

9 Claims, 16 Drawing Figures

RAIL FENCE

FIELD OF INVENTION

The present invention relates to fences and, more particularly, to a rail type fence having assembly means to facilitate erection of the fence and for the provision of a rail fence which is relatively imperishable.

BACKGROUND OF THE INVENTION

The fences exemplified in the prior art typically utilize wood posts and rails, whose exterior surfaces are generally stained or painted in an effort to retard decay or rotting.

Unfortunately, even with frequent staining or painting, wood type fences have the tendency of developing splits which expose the interior surfaces of the wood and, thereby, exacerbates rotting.

Decay of such wood fences is most prevalent at and about the portion of the post members which are buried in the earth to provided the vertical support for the fence.

The obvious disadvantage of the prior art fences, in addition to those noted above, are that the wood posts and rails may develop surface splinters which, in turn, can cause injuries; and that periodic expensive maintenance and replacement of rotted members are required. It is to be noted that another disadvantage exists with the prior art post and rail wood fences, that being that internal rot may have weakened a post or rail such that a potential exists for serious injury with such member suddenly breaking under the weight of an unsuspecting person who may have sat or rested on said (internally) rotted fence member.

In contrast to the prior art, the present invention provides a post, rail and accessory members for a fence structure which are virtually imperishable, are of relative light weight, require little or no maintenance, facilitates erection of the fence structure and substantially, if not entirely, eliminates the risk of injury which, as noted above, may be caused by splintering and/or sudden breaking of (wood) post and rail members. The accessory members may comprise coupling joints, post caps, grass prevention rings and post mounting spikes, which will be described in greater detail hereafter.

SUMMARY OF THE INVENTION

A post and rail fence structure having particular utility, for example, about dwellings etc. situated in a region where the climatic and/or soil and/or insect conditions may tend to cause damage to the fence structure, comprising:

a post member (21,58) formed from a plastic or resin or other like material to have a predetermined rigidity, tactility and tensile strength, said post member being generally square or round shaped with a hollow interior elongate core (25,61), said post member having a predetermined exterior surface characteristic(s). for example, a simulated stained wood finish with indentations, formed in the plastic/resin material to provide a substantially permanent and generally imperishable surface, said post member having one or more rail mounting slots; and a rail member (22,52) formed from a plastic or resin or other like material to have a predetermined rigidity, tactility and tensile strength, said rail member having an intermediate portion (22,52) and two end mounting beam portions (49,53,66) each configured for being received within a respective rail mounting slot of two spaced apart post members, said intermediate portion having a round or a square or a semi-round or a split rail configuration, said rail member having a predetermined exterior surface characteristic(s), for example, a simulated stained wood finish with indentations, formed in the plastic/resin material to provide a substantially permanent and generally imperishable surface, said rail member having a substantially hollow interior to provide a relatively light weight rail member.

Another feature of the invention comprises a plurality of accessory members formed of and having surface characteristics similar to the post and rail members of the fence structure. For example, a cap member (23) and a grass prevention ring (40,80) and a post mounting spike (39) and various types of coupling/joining members (71, 49, 53, 66) may be provided to facilitate erection of the fence structure in accordance with the present invention.

Accordingly, it is an object of the present invention to provide a new and improved fence device or structure.

Another object of the present invention is to provide a plurality of fence members which are substantially imperishable.

A further object of the present invention is to provide a fence device/structure which substantially reduces the risk of injury from splinters and breaking post and rail members.

A further object of the present invention is to provide a fence structure which is generally impervious to water.

A further object of the present invention is to provide a fence structure which is substantially maintenance free.

A further object of the present invention is to provide a fence structure which is not subject to rot, decay or insect damage.

A further object of the present invention is to provide a fence structure that is readily erectable.

A further object of the present invention is to provide a fence structure which obviates replacement of rotted, decayed or insect damage members thereby reducing the long term costs of the fence.

BRIEF DESCRIPTION OF THE DRAWINGS

Other objects and advantages of this invention may be seen more clearly from the following description when viewed in conjunction with the accompanying drawings. Like numerals refer to like parts throughout.

DESCRIPTION OF THE PREFERRED EMBODIMENTS

Figure 1:
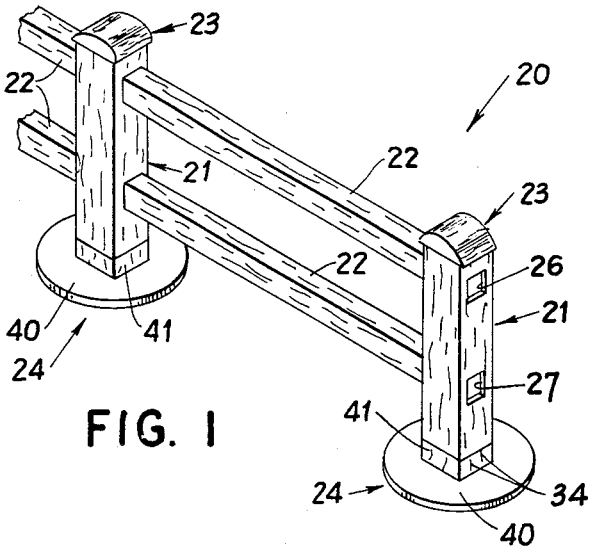
FIG. 1 is a perspective view of a post and rail fence structure in accordance with the invention.
Figure 2:
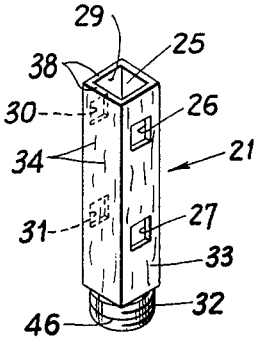
FIG. 2 is a perspective view of the post member illustrated in FIG. 1.
Figure 3:
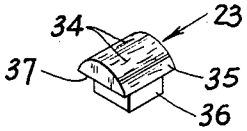
FIG. 3 is a perspective view of the cap member illustrated in FIG. 1.
Figure 4:
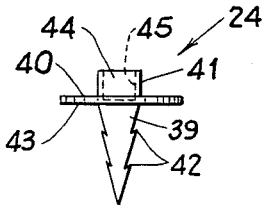
FIG. 4 is a plan view of a post mounting spike in accordance with the invention.
Figure 5:
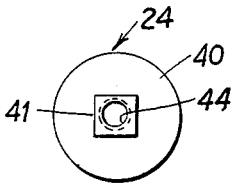
FIG. 5 is a top view of the post mounting spike illustrated in FIG. 4.
Figure 6:
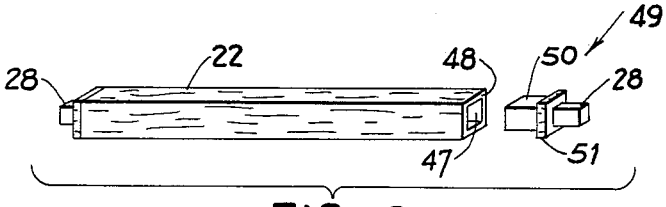
FIG. 6 is a perspective view, partly exploded, of a square or rectangular rail member in accordance with the invention.

Referring to the drawings, particularly FIGS. 1–6, there is shown a post and rail fence 20 and accessory members constructed in accordance with the invention to be relatively imperishable, virtually maintenance free, easily assembled or erected and to provide a substantially safer fence 20 structure.

The fence 20 structure basically comprises vertically mountable post member(s) 21 and a rail member(s) 22. The post member 21 may be supported-mounted in vertical disposition by means of a post mounting spike 24. The constituent component parts or members of the fence 20 structure are formed from a plastic, resin, phenolic or other similar material which is generally imperishable and not subject to climate or insect related deterioration.

The post member 21 has a generally elongate square beam configuration with an opening at its top end extending into a hollow interior space 25. One or more square peg receiving holes 26 and 27 are provided for receiving a mating peg 28 extending from an end of a respective rail member 22. The opposite side wall 29 has aligned peg receiving holes 30 and 31 (shown in phantom outline in FIG. 2) for receiving a respective rail peg 28. In this manner, a two rail fence may be extended between successive pairs of spaced apart post members 21. The post member 21 has walls of a predetermined thickness, for example, approximately one-fourth of an inch, to provide a desired rigidity while being light weight relative to the prior art wood post members. The other end of post member 21 has a downwardly projecting round screw-like member 32. Screw member 32 may be integrally formed with post member 21 or affixed thereto as a separate accessory part in similar manner as peg member 28, which will be described in more detail hereafter. The exterior of post member 21 has a surface 33, for example, integrally formed with or baked on or embedded in or moulded-in the (plastic) post material to simulate, for example, a wood grain finish. The moulded-in surface may include indentations 34 and a stained or painted appearance, for example, having an antique grey or light brown or dark brown color, to simulate an aged wood lock.

A cap member 23 formed of similar (plastic) material and having a, for example, curved convex upper surface 35 with a moulded-in surface look or appearance similar to that of the post member 21. The bottom surface (not shown) of cap member 23 is contoured to form a substantially square shaped downwardly projecting wall or plug member 36. Plug member 36 is dimensioned to snugly fit or force fitted within opening 25 with ledge portions 37 extending over and abutting on the wall edge 38 of post member 21.

Post mounting spike 24 is formed of, for example, a plastic or phenolic material and comprises a downwardly projecting spike 39, grass prevention ring or disc 40, and an upwardly projecting nut like member 41. Spike 39 may be of triangular shape, cone shape or spear shape and is dimensioned for being placed or pounded into the soil so as to provide a stable foundation for a respective post member 21. Spike 39 may include a plurality of upwardly projecting bobs 42 to more securely retain post mounting spike 24 in the soil/earth. Disc 40 is dimensioned to serve the dual function of a footing or tilt prevention circular ledge about nut member 41 and a respective mounted post member 21, and also as a grass prevention plate or cover about a predetermined diameter of the respective post member 21. Thus, the post mounting spike 24 is placed in a prepared hole or pounded into the earth such that the bottom surface 43 rests or abuts on the earth (ground surface). The nut shaped member 41 has an interior space 44 dimensioned to receive the bolt end 32 of a post member 21. The interior walls 45 of nut member 41 have threads formed to matingly receive the threads 46 about bolt or screw end 32.

Accordingly, with a post mounting spike 24 securely placed into the earth as noted above, a respective post member 21 may be mounted thereto by screwing/bolting its screw/bolt end 32 into the nut portion 41 of the post mounting spike 24. Preferably the post member 21 is rotated until it is firmly held within nut member 41 and the corners of the post member 21 align with the corners of nut member 41.

Thence, cap member 23 is affixed atop its respective post member 21.

The rails 22 are each of elongate square/rectangular configuration with a hollow interior space or core 47. Each rail 22 is formed of similar material as the post members 21 and have, for example, a moulded-in simulated wood surface or finish as the post 21 and cap 23 members. The thickness of the walls 48 of rails 22 are predetermined so as to provide a desired rigidity, for example, to withstand the weight of one or more persons. It should also be pointed out at this time that the plastic or other type material forming the rail and/or post members may be selected such that under excessive weight or strain they slowly bend and do not suddenly break. In this manner physical injury may be avoided.

Each end of a rail 22 (see FIG. 6) is dimensioned to receive or accommodate a respective end (accessory) member 49. End member 49 comprises a generally square/rectangular plug 50, a body portion 51 and an outwardly projecting peg member 28. Each plug 50 is dimensioned and configured to be snugly or force-fitted into an opening 47 at an end of a respective rail member 22. Body member 51 is configured to extend beyond opening 47 and matingly abut with walls 48. Peg 28 is dimensioned for being received within a peg receiving hole 26,27,30 or 31 of a post member 21.

It should be recognized that in addition to the snug or force-fit of the plug portions 36 and 50 of (accessory) members 23 and 49 with the openings 25 and 47 of post member 21 and rail member 22, respectively, that such plug portions may be cemented or epoxied to the interior wall surfaces of the respective post and rail members. In this manner, improved affixation may be achieved.

Figure 7:
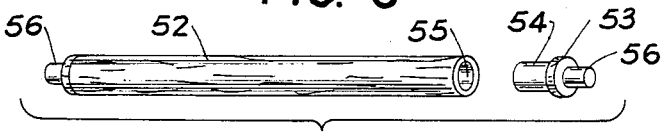
FIG. 7 is a perspective view, partly exploded, of a round rail member in accordance with the invention.

With reference to FIG. 7, an alternative construction of the rail member is shown. The rail member 52 shown in this drawing is similar to that shown in FIGS. 1 and 6 with the exception that the rail member 52 is round or of cylinder or pipe like configuration. Likewise, peg member 53 has a round plug 54 dimensioned to fit within opening 55 and a rod shaped peg 56 dimensioned to fit within a respective round peg receiving hole 57 of post member 58.

Figure 9:
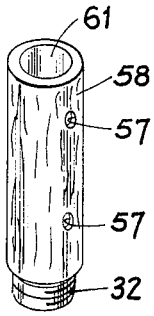
FIG. 9 is a perspective view of an alternative embodiment of the post member in accordance with the invention.
Figure 10:
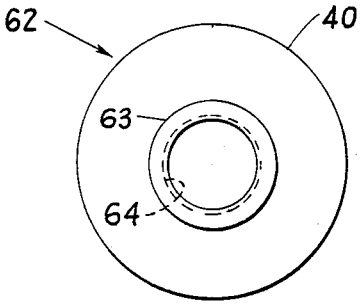
FIG. 10 is a top plan view of an alternative embodiment of the post mounting spike in accordance with the invention.
Figure 11:
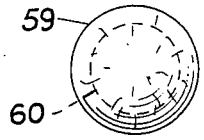
FIG. 11 is a top plan view of an alternative embodiment of the post cap member in accordance with the invention.
Figure 12:
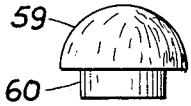
FIG. 12 is a side view of the post cap member illustrated in FIG. 11.

With reference to FIGS. 9,10,11 and 12, alternative embodiments or construction of the post member, cap and post mounting spike are shown. In FIG. 9, a generally round shaped post member 58 is illustrated having a plurality of round peg receiving holes 57. The cap 59 is mushroom shaped with a circular stem or plug 60 dimensioned to be force-fitted into opening 61 of the round post member 58. The post mounting spike 62 is similar to that shown in FIG. 4 with the exception that the nut portion 63 has a generally round exterior configuration dimensioned to mate with the exterior surface of post member 58 with bolt 32 being screwed/bolted into the internally threaded 64 nut portion 63.

Figure 8:
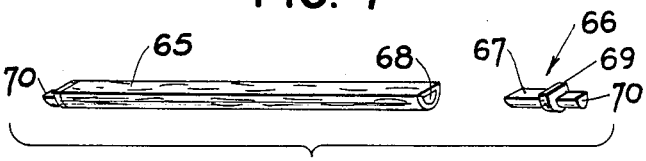
FIG. 8 is a perspective view, partly exploded, of a split rail member in accordance with the invention.

With reference now to FIG. 8, an alternative embodiment of the rail member is shown. The rail member 65 is similar to the rail member 52 shown in FIG. 7, with the exception that rail member 65 is configured to have a split rail or half-round appearance. Similarly, the peg end or accessory attachment 66 is configured to have a plug 67 to snugly fit into opening 68 and a split rail shaped body portion 69. Peg 70 is round shaped since the split rail 65 may be utilized with a round post member 58.

It should be noted at this time that the desired finish, for example, stained wood grain, on the exterior surface of the post, rail and accessory/attachment members shown in FIGS. 6–12 may be selectively moulded into the (plastic) material forming these members. Also, the exterior surface of the nut member 63 may be similarly finished to blend with the post 58.

Figure 13:
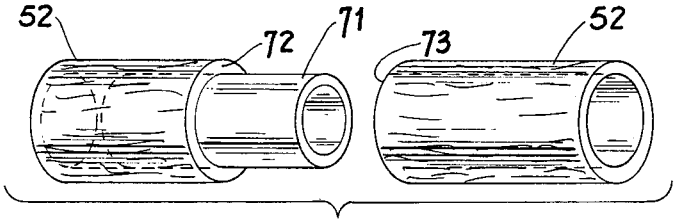
FIG. 13 is a diagrammatic view illustrating a plug or joining member in accordance with the invention.

With reference to FIG. 13, there is shown an accessory/attachment coupling device 71 in accordance with an additional feature of the present invention. The coupling device 71 basically comprises a tubular shaped plug having a diameter slightly less than the internal diameter of two separate round rail members 52. Thus, by inserting a portion of coupling (plug) member or device 71 into an end of two rails and pushing said rails together such that rim 72 abuts rim 73, the two rails are joined together. In this manner, rails may be repaired, lengthened or shortened as required or desired. It should be understood that coupling members having other configurations may be provided such as square to fit into opening 47 of rail 22 or a split rail shaped coupling member (not shown) to accommodate rail 52. Also, exterior coupling members (not shown) are contemplated such as a ring or short tubular member fitted about the exterior of the two rails to be joined together.

Figure 14:
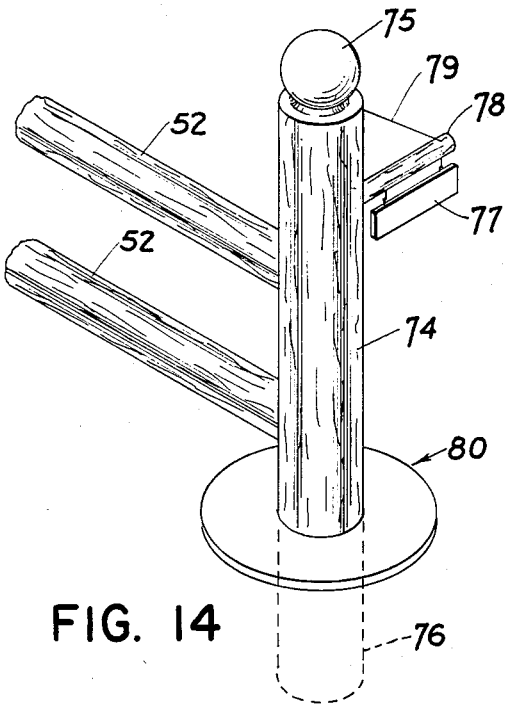
FIG. 14 is a perspective plan view of a driveway light-post member and fence, partly cutaway, in accordance with the invention.

With reference now to FIG. 14, an alternative embodiment of a post member is shown. The post member 74 is similar to the post member shown in FIG. 9, with the exception that post member 74 is of substantially greater length and does not have a threaded bottom(-bolt) end of smaller diameter. Post member 74 is primarily intended as a beginning or driveway post section with, for example, a light bulb 75 atop thereof. In erecting the fence structure, a bottom portion 76 of post member 74 is placed in a hole in the earth to provide vertical stability thereto. Also, a sign 77 mounting pole 78 may be cantilevered from post member 74 and a support cable 79 affixed between a portion of pole 18 and post member 74. A grass prevention ring or disc 80 may be provided about post member 74 at the ground level to prevent or reduce grass from growing around the post members.

Figure 15:
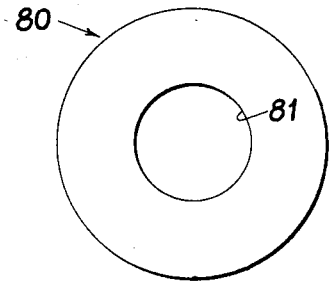
FIG. 15 is a top view of a grass preventive ring in accordance with the invention.
Figure 16:
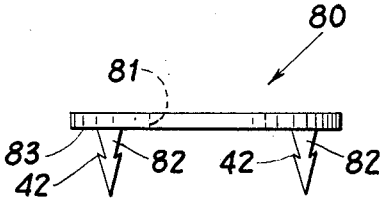
FIG. 16 is a side view of the grass preventive ring illustrated in FIG. 15.

With reference to FIGS. 15 and 16, a separate grass prevention disc 80 is shown. Grass prevention disc 80 is basically ring shaped with an inside hole 81 dimensioned to enable disc 80 to be slipped over a round post member 74. One or more downwardly projecting spike members 82 are provided about bottom surface 83 for being pounded into the earth about the post member thereby holding the disc in position.

It should be appreciated that use of a grass prevention disc 40,80 substantially prevents growth of grass about the post member and tends to obviate the need for cutting, mowing or edging the lawn thereabout.

The post and rail members may be of desired length and diameter. However, it is contemplated that these members may be of a dimension, for example, with rail members being approximately eight feet in length and three inches in diameter and the post members being approximately four to six inches in diameter and between four feet and eight feet in length.

It is to be understood that the above described arrangements are illustrative of the application of the principles of the invention. Other arrangements may be devised by those skilled in the art without departing from the spirit and scope of the invention. For example, post members 21 and 58 may be made of substantially greater length and without bolt end 32 so that their bottom portions may be burried in the earth to provide the necessary stability and support thereto. Also it should be recognized that the hollow space within one or more of the post members 21,58,74, after their placement or vertical mounting either in mounting spikes 24 or the earth, and placement of the posts may be filled with cement or earth to provide increased stability.

We claim:

1. A fence structure comprising: a post means having an elongate configuration with an interior space extending substantially along the length of said post means, said post means having at least one rail mounting alcove formed within a side wall portion of said post means, said post means having a threaded bottom mounting end portion, said post means being formed of a plastic material to have a predetermined rigidity and tactility and tensile strength, said post means having a predetermined exterior surface characteristic; a post mounting spike comprising a downwardly projecting spike means, an intermediate disc and a upwardly projecting member having means with internal threads for matingly receiving the threaded bottom mounting end portion of said post means, said post mounting spike being formed of a plastic material to have a predetermined rigidity and tactility and tensile strength; A rail means having an elongate configuration with an interior space extending substantially along the length of said rail means, said rail means having a mounting end member at each end thereof each configured for being receivably mounted within a respective rail mounting alcove, said rail means being formed of a plastic material to have a predetermined rigidity and tactility and tensile strength, said rail means having a moulded-in exterior surface characteristic.

2. A fence structure as in claim 1, wherein:
the post means is generally tubular shaped.

3. A fence structure as in claim 1, wherein:
the rail means is generally tubular shaped.

4. A fence structure as in claim 1, wherein:
the post means has an elongate rectangular beam shape, and
the rail means has an elongate rectangular beam shape.

5. A fence structure as in claim 1, wherein:
the rail means has an elongate split rail shape.

6. A fence structure as in claim 1, wherein:
the post means has an elongate substantially square beam configuration being open at a top end and having a round threaded bottom end member, said post means has a selected coloration and indentations moulded-in the exterior surface thereof to simulate the appearance of an aged wood posed, said post means including a contoured cap member for being placed atop said post means to close the opening at the top of said post means, and
the rail means as an elongate substantially square beam shaped body portion, said mounting end member comprising an outwardly projecting substantially rectangular shaped peg being of smaller dimension than said body portion, said rail means has a selected coloration and indentations moulded-in the exterior surface thereof substantially similar to that of said post means.

7. A fence structure in claim 1, wherein:
the post means has an elongate tubular configuration being open at a top end, said post means has a predetermined moulded-in coloration and surface characteristics to substantially simulate a wood material, said post means includes a contoured cap member mountable atop said post means over the opening at the top of said post means; and
the rail means has an elongate substantially tubular shaped body portion, said mounting end member comprises a discrete cap means affixable at the end of said body portion and having a round peg outwardly projecting portion dimensioned for being insertable within one of said rail mounting alcoves, said rail means and cap means have a predetermined moulded-in-coloration and surface characteristic to substantially simulate a wood material.

8. A post and rail structure having particular utility for erecting a fence structure on a parcel of land with the fence structure being exposed to climatic and soil environmental conditions, comprising:
a post member formed from a plastic like material to have a predetermined rigidity and elasticity, said post member having an upper post section and a ground support member, said ground support member being configured for being mountable within a portion of the parcel of land for supporting said upper post section generally in a vertical disposition upwardly from the parcel of land, said upper post section having rail support means, said post member having a predetermined integrally formed configuration and exterior surface finish, said upper post section comprises a generally square shaped hollow elongate beam being open at a top end and having an external threaded male portion at a bottom end, said ground support member comprises a spike like portion configured for being insertable into the soil and having a grass prevention disc configured for abuting a portion of the soil surface about said upper post section and having an upper nut section with an opening having internal thread members for matingly receiving said threaded male portion of said upper post section whereby said post member being vertically mountable, said upper post section and said nut section having a moulded-in surface finish simulative of a stained/painted wood surface; and
a rail member formed from a plastic material to have a predetermined rigidity and elasticity, said rail member having an elongate body section and two rail mounting end caps each affixable at a respective end of said body section and being configured for being receivably mountable to said rail support means, said rail member having a predetermined integrally formed configuration and exterior surface finish, said body section having a generally square hollow beam shape being open at both ends, said rail mounting end caps each comprising a square plug section dimensioned for being inserted within a respective open end of said body section and an intermediate section and a square peg section dimensioned for being mountingly received by a respective rail support means.

9. A post and rail structure as in claim 8, with accessory members including:
a cap means configured to be affixed atop said upper post section;
a coupling means for joining two separate rail members;
a driveway post.

* * * * *